United States Patent [19]

Stich et al.

[11] Patent Number: 4,740,042

[45] Date of Patent: Apr. 26, 1988

[54] APPLIANCE DOOR HAVING STIFFENED INNER PANEL WITH SHELVES AND METHOD OF FORMING

[75] Inventors: Richard A. Stich; Walter E. Lewis, both of Louisville, Ky.

[73] Assignee: General Electric Company, Louisville, Ky.

[21] Appl. No.: 20,579

[22] Filed: Mar. 2, 1987

[51] Int. Cl.[4] ..... A47G 29/00

[52] U.S. Cl. ..... 312/138 A; 312/214; 108/901

[58] Field of Search ..... 312/138 A, 214; 108/901; 220/71, 23.2

[56] References Cited

U.S. PATENT DOCUMENTS

| | | | |
|---|---|---|---|
| 1,069,204 | 8/1913 | Thien et al. . | |
| 1,269,197 | 6/1918 | Mendenhall . | |
| 1,518,668 | 12/1924 | Mitchell . | |
| 1,686,831 | 10/1928 | Matchette . | |
| 2,144,945 | 1/1939 | Sutton | 220/71 |
| 2,533,431 | 12/1950 | Chausson | 220/71 |
| 2,706,140 | 4/1955 | Hinkel | 312/214 |
| 2,746,828 | 5/1956 | Amore | 312/138 A |
| 2,903,315 | 9/1959 | Schory et al. | 312/138 A |
| 3,024,942 | 3/1962 | Schmitz . | |
| 3,154,215 | 10/1964 | Le Vesconte . | |
| 3,405,666 | 10/1968 | Miller | 108/901 |
| 3,719,157 | 3/1973 | Arcocha et al. | 108/901 |
| 3,780,903 | 12/1973 | Clarkin et al. | 220/71 |
| 4,103,857 | 8/1978 | Levenhagen | 108/901 |
| 4,183,491 | 1/1980 | Sanders et al. | 108/901 |
| 4,361,368 | 11/1982 | Daniels | 312/138 A |

FOREIGN PATENT DOCUMENTS

| | | | |
|---|---|---|---|
| 631401 | 11/1961 | Canada | 312/138 A |

*Primary Examiner*—Victor N. Sakran
*Attorney, Agent, or Firm*—Frederick P. Weidner; Radford M. Reams

[57] ABSTRACT

A refrigerator door has its plastic inner panel, which has a plurality of container supporting shelves extending therefrom, stiffened through forming integral vertical stringers adjacent each other across substantially the entire width of the surface of the inner panel between the shelves. Gussets extend from one end of each of the integral stringers into one of the upper and lower surfaces of each adjacent shelf. The integral stringers are V-shaped or U-shaped in cross section. The gussets are V-shaped when the integral stringers are V-shaped and may be V-shaped or U-shaped when the integral stringers are U-shaped. The integral stringers stiffen the entire door without adding material and control the stiffness through the cross sectional moment of inertia of each of the integral stringers. When there is a lack of space beneath the bottom shelf, the gussets cannot be employed, but a shadow line is used to increase the moment of inertia. The integral stringers have an aesthetic pattern in either the V-shaped or U-shaped configuration.

20 Claims, 6 Drawing Sheets

APPLIANCE DOOR HAVING STIFFENED INNER PANEL WITH SHELVES AND METHOD OF FORMING

FIELD OF THE INVENTION

This invention relates to an appliance door having container supporting shelves on an inner panel and a method of forming and, more particularly, to a stiffening arrangement for providing rigidity to an inner panel of an appliance door having container supporting shelves and a method of forming.

BACKGROUND OF THE INVENTION

In a refrigerator door formed of a metallic outer panel connected to a plastic inner panel with thermal insulating foam means therebetween, the smooth surface of the inner panel has shelves formed integral therewith to accommodate containers for support. This has enabled containers such as bottles, for example, in particular to be stored on the shelves of the inner panel of the door.

However, the size of the shelves has been limited because the load that the inner panel was capable of supporting has been dependent on the thickness of the inner panel. The load carrying capability of the inner panel has been determined by peak stresses to which the inner panel is subjected for a specific thickness of the inner panel.

To store larger size containers on the shelves of the inner panel of the refrigerator door, it has been necessary to increase the thickness of the inner panel until the door is sufficiently rigid. However, this has substantially increased the material cost when it is desired to support larger size containers.

Thus, the cost of the plastic of the inner panel has limited the maximum thickness at which the inner panel can economically be made. As a result, the size of the shelves has been limited for most refrigerators so that they have not been able to accommodate relatively heavy containers.

The present invention satisfactorily solves this problem through having the inner panel of the refrigerator door capable of supporting relatively large loads in comparison with presently available inner panels of refrigerator doors while still forming the inner panel of the same material. Additionally, the thickness of the inner panel can be reduced about forty per cent for the same load when using the inner panel of the present invention so that significant savings in material costs are obtained while still being able to support greater loads on the shelves of the inner panel than presently available refrigerator doors.

The thickness of the inner panel of the door of the present invention is substantially reduced while accommodating larger loads through controlling the stiffness of the door by forming integral stringers of a V-shaped or U-shaped configuration between the shelves of the inner panel. Each of these stringers has a cross sectional moment of inertia; the moment of inertia is inverse to the deflection created by the load on the shelf. Thus, an increase in the moment of inertia of each of the integral stringers of the inner panel increases the stiffness through decreasing the deflection created by the load on the shelf. The moment of inertia of each of the integral stringers can be varied through varying its width, its height, or its pattern shape.

Each of the shelves is rigidized against deflection under load by extending each of the integral stringers into a gusset or truss, either beneath or above the shelf. The gusset preferably has the same pattern shape as the integral stringer from which it extends.

The use of the integral stringers and the gussets diffuses the stress throughout the inner panel rather than at local areas of the inner panel as occurs with previously used smooth surface designs. This enables a relatively large load to be supported by relatively thin material.

By selecting the shape of the pattern as a V-shape or a U-shape, the aesthetic appearance of the inner panel is enhanced. By using different pattern shapes with inner panels of different price model lines, a differentiation between model lines is produced.

SUMMARY OF THE INVENTION

An object of this invention is to provide an appliance door having a uniquely stiffened inner panel.

Another object of this invention is to provide a stiffened inner panel of an appliance door having an aesthetic appearance.

A further object of this invention is to provide an appliance door having an inner panel capable of supporting a much larger load on its shelves with the same thickness of the inner panel.

Still another object of this invention is to provide a method of stiffening an inner panel of an appliance door while having an aesthetic appearance.

A still further object of this invention is to provide a method of forming an inner panel of an appliance door that is capable of supporting a much larger load on its shelves with the same thickness of the inner panel.

Other objects of this invention will be readily perceived from the following description, claims, and drawings.

BRIEF DESCRIPTION OF THE DRAWINGS

The attached drawings illustrate preferred embodiments of the invention, in which.

DESCRIPTION OF THE PREFERRED EMBODIMENTS

Figure 1:
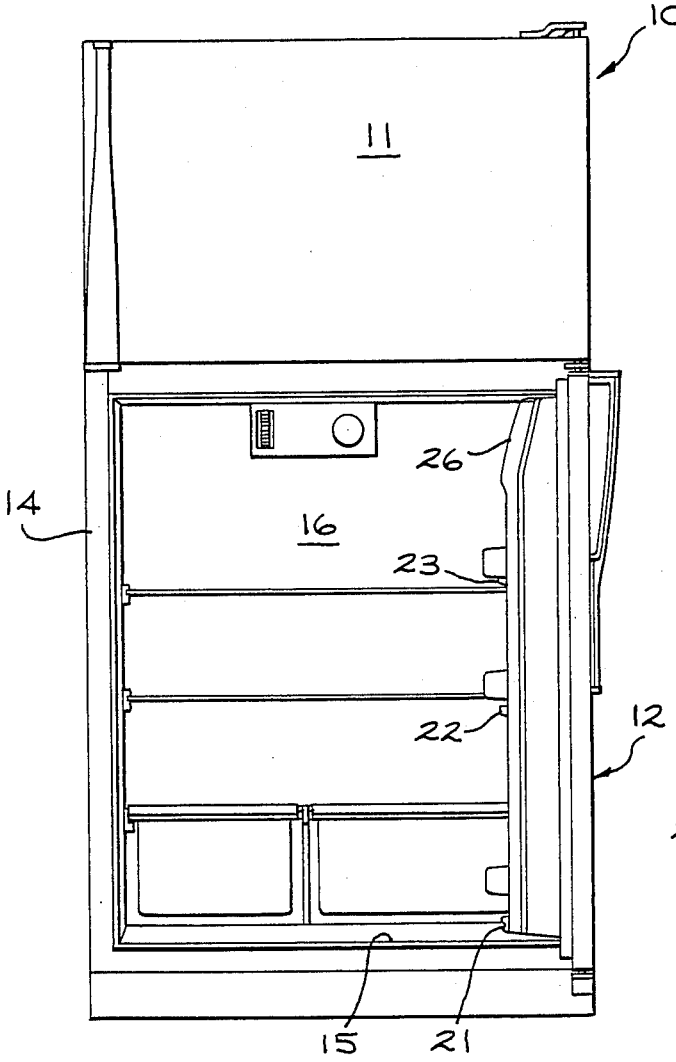
FIG. 1 is a front elevational view of a refrigerator cabinet with its lower door in an open position and having an inner panel of the lower door stiffened in accordance with the present invention.

Referring to the drawings and particularly FIG. 1, there is shown a refrigerator cabinet 10 having an upper door 11 and a lower door 12. The upper door 11 closes an access opening (not shown) in a front wall 14 of the refrigerator cabinet 10 to a freezer compartment (not shown). The lower wall 12 closes an access opening 15 in the front wall 14 to a fresh food compartment 16.

Figure 2:
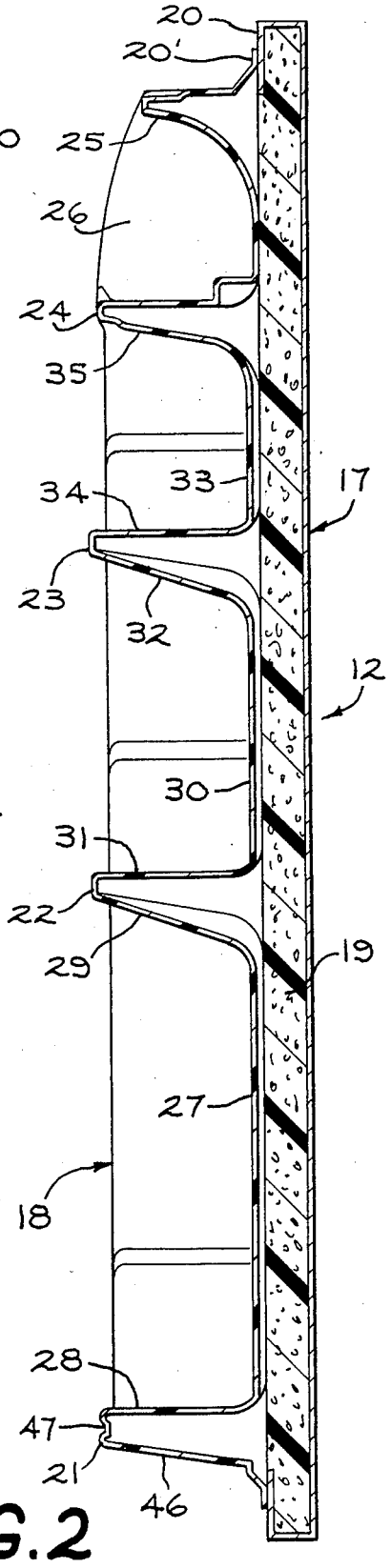
FIG. 2 is a longitudinal sectional view of the lower door of FIG. 1 having the stiffened inner panel.

As shown in FIG. 2, the lower door 12 includes a metallic outer panel 17 and an inner panel 18 of a plastic such as ABS, for example, connected to each other with an insulating foam 19 therebetween. The outer panel 17 has a flange 20 at its rear extending around its entire periphery and with which a peripheral mounting flange 20' of the inner panel 18 is attached by suitable means such as screws extending through holes and notches in the mounting flange 20' into screw start holes in the flange 20, for example.

The inner panel 18 has a bottom shelf 21, two intermediate shelves 22 and 23, and a top shelf 24 formed integral therewith. There also is an upper portion or wall 25 adjacent the upper end of the inner panel 18 and formed integral therewith. The upper portion 25 prevents escape of refrigerated air from the fresh food compartment 16 (see FIG. 1) and turns off a light (not shown) therein when the door 12 is in its closed position.

The inner panel 18 (see FIG. 2) has a side wall or connector 26 extending from each end of the upper portion 25 to each end of the bottom shelf 21. The side walls or connectors 26 carry part of the load on the substantially horizontal shelves 21–24 as they are secured to opposite ends of each.

The inner panel 18 includes a substantially vertical surface 27 extending between an upper surface 28 of the lower shelf 21 and a lower surface 29 of the intermediate shelf 22, a substantially vertical surface 30 extending between an upper surface 31 of the intermediate shelf 22 and a lower surface 32 of the intermediate shelf 23, and a substantially vertical surface 33 extending between an upper surface 34 of the intermediate shelf 23 and a lower surface 35 of the upper shelf 24. Each of the surfaces 27, 30, and 33 of the inner panel 18 is similarly formed.

Figure 3:
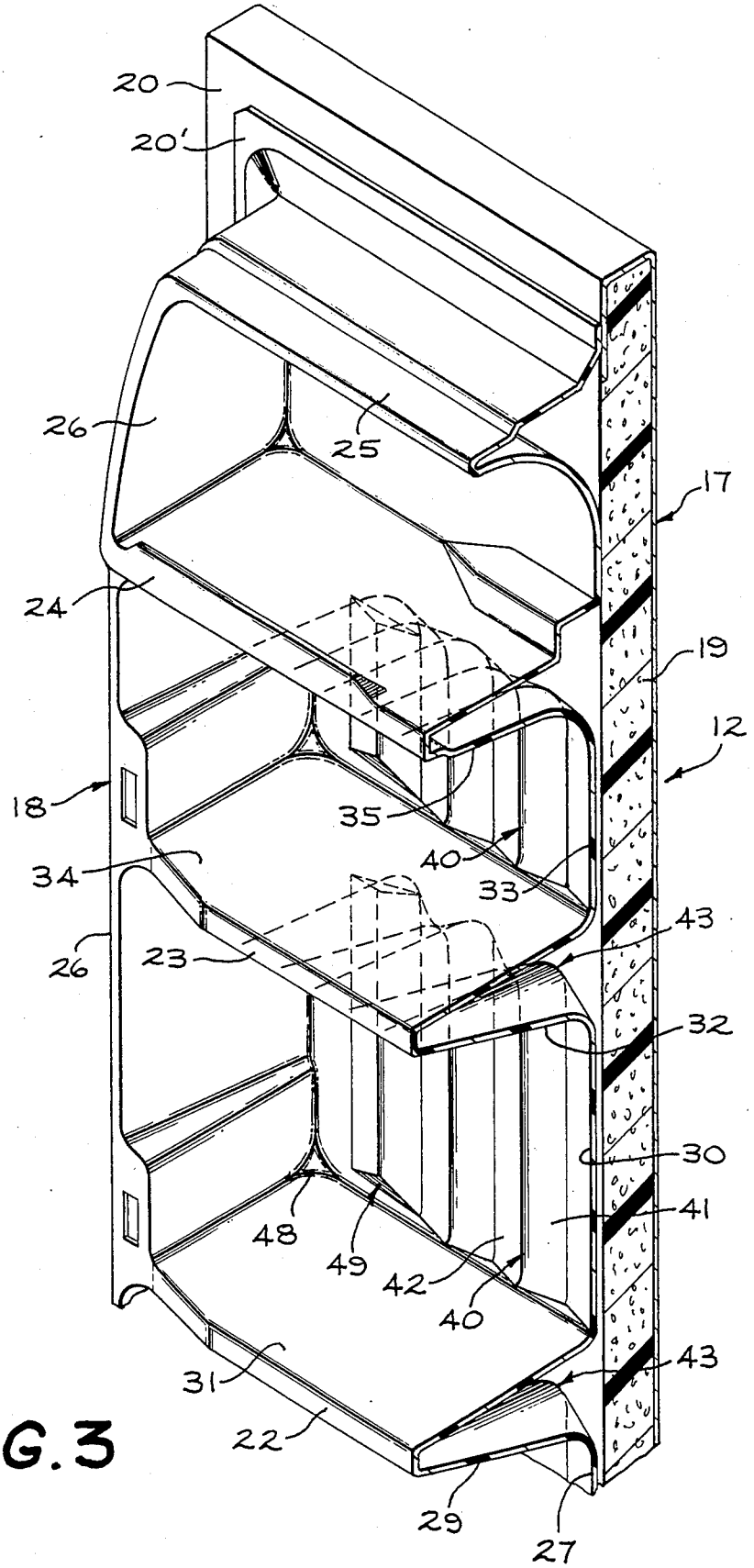
FIG. 3 is a fragmentary isometric view, partly in section, of a portion of the door of FIG. 2 and showing stiffening of the inner panel through the use of V-shaped stringers with V-shaped gussets for shelves integral with the inner panel.
Figure 4:
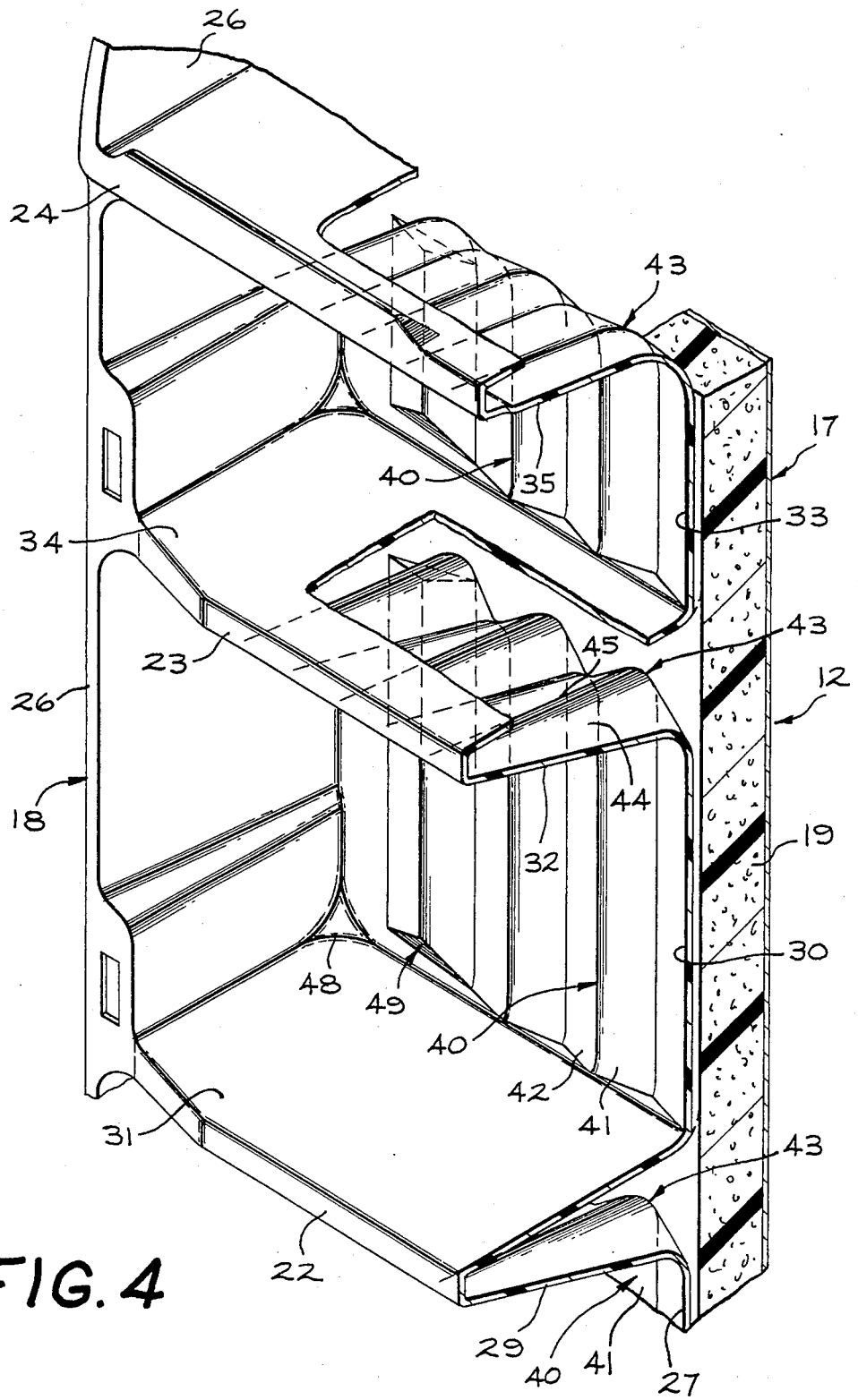
FIG. 4 is an enlarged fragmentary isometric view, partly in section, of a portion of the door of FIG. 3 and showing details of the V-shaped gussets for stiffening the shelves.

As shown in FIGS. 3 and 4, the surface 30, for example, has a plurality of integral stringers 40 formed therein adjacent to each other in a V-shape. Each of the stringers 40 extends from the upper surface 31 of the intermediate shelf 22 to the lower surface 32 of the intermediate shelf 23. The integral stringers 40 terminate prior to each of the side walls or connectors 26. The surfaces 27 and 33 of the inner panel 18 are similarly formed with the integral stringers 40.

Each of the integral stringers 40 is identical with each of its sides 41 and 42 being identical. Since an increase in the moment of inertia of each of the integral stringers 40 increases the stiffness of the surface 30, for example, of the inner panel 18 so as to decrease the thickness of the inner panel 18 to support a specific load, it is desired to have the moment of inertia an optimum consistent with an aesthetic appearance of the surfaces 27 (see FIG. 2), 30, and 33 of the inner panel 18. Because a plastic such as ABS, for example, will crack when subjected to too high a strain, the moment of inertia is selected so that such will not occur while still increasing the stiffness.

Figure 6:
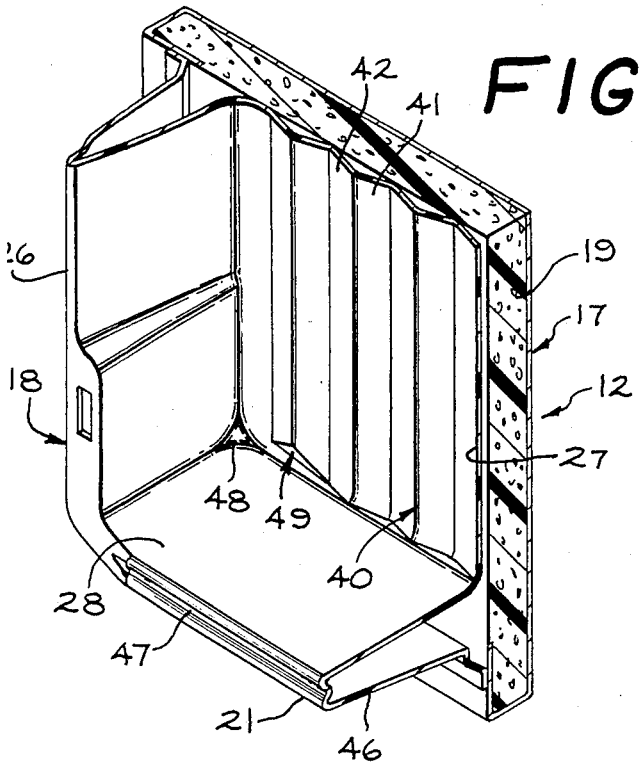
FIG. 6 is an enlarged fragmentary isometric view, partly in section, showing the lowermost portion of the door of FIG. 1 having its inner panel formed with V-shaped stringers and its bottom shelf stiffened only by a shadow line.

For a specific thickness of the inner panel 18, the moment of inertia can be increased by increasing the angle of the sides 41 (see FIG. 3) and 42 of the stringer 40 to each other. The moment of inertia also can be increased by increasing the distance between the spaced ends of the sides 41 and 42. As shown in FIG. 6, only the spaced ends of the sides 41 and 42 of each of the integral stringers 40 engage the insulating foam 19.

Figure 9:
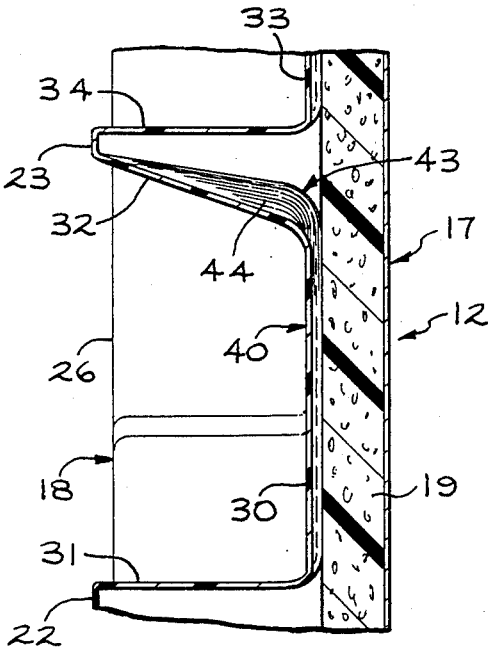
FIG. 9 is an enlarged fragmentary longitudinal sectional view of a portion of the door of FIG. 1 and showing the blending of a V-shaped stringer on the inner panel with a V-shaped gusset on a lower surface of a shelf.

As shown in FIGS. 4 and 9, each of the integral stringers 40 in the surface 30 blends into a gusset or truss 43 in the lower surface 32 of the intermediate shelf 23. As shown in FIG. 4, the integral stringers 40 in the surfaces 27 and 33 similarly blend into the gussets or trusses 43 in the lower surface 29 of the intermediate shelf 22 and the lower surface 35 of the upper shelf 24, respectively.

The gusset or truss 43 has the same configuration as the integral stringer 40 so that it has two sides 44 and 45. Because of the height of the shelf 23, the sides 44 and 45 are at a different angle to each other than the sides 41 and 42 of the integral stringer 40.

The moment of inertia of each of the gussets or trusses 43 strengthens the intermediate shelf 23 so that it does not deflect to the same extent as it would if it did not have the gussets or trusses 43. This decreases the required thickness of the inner panel 18 while still maintaining the load supporting capability.

Because of the location of the bottom shelf 21 (see FIG. 2) so close to the bottom of the door 12, it is not possible to form any of the integral stringers 40 (see FIG. 3) therebeneath or the gussets or trusses 43 in lower surface 46 (see FIG. 2) of the bottom shelf 21. Instead, the bottom shelf 21 has a shadow line 47, which is a groove, formed in its portion joining the upper surface 28 and the lower surface 46 of the bottom shelf 21. The shadow line 47 provides enhancement of the moment of inertia in addition to providing an aesthetic appearance. The increased moment of inertia is due to the moment of inertia of a flat plate being proportional to its thickness and height and the shadow line 47 increases the equivalent thickness.

The integral stringers 40 (see FIG. 3) extend for approximately 90 to 95 per cent of the width of each of the surfaces 27, 30, and 33 of the inner panel 18. The gussets 43 extend for the same distance as the integral stringers 40.

Because of a large ball radius 48 (see FIG. 4) at the junction of the top surface 31 of the shelf 22 and the side wall or connector 26, for example, the integral stringers 40 cannot extend for the entire width of the surfaces 27, 30, and 33. This is because of the material thinness of the ball radius 48 and the ball radius 48 preventing a load concentration at its location. While the ball radius 48 is shown only at the top surface of the various shelves, it should be understood that a ball radius, which is usually much smaller than the ball radius 48, may be employed at the bottom surface of the various shelves if desired.

Accordingly, as shown in FIGS. 3 and 4, for example, a decorative stringer 49 may be employed at each end of the integral stringers 40. Since the decorative stringer 49 is not intended as a load carrying stringer, one of the gussets 43 is not disposed above the decorative stringer 49.

It should be understood that only one of the decorative stringers 49 is used at each end of the integral stringers 40 in each of the surfaces 27, 30, and 33. If the spacing of the last of the integral stringers 40 from the side wall or connector 26 would be such that it would require two of the decorative stringers 49 at each end of the integral stringers 40, then the spaced ends of the sides 41 and 42 of each of the integral stringers 40 would be moved further apart so as to require only one of the decorative stringers 49 at each end of the integral stringers 40.

Figure 5:
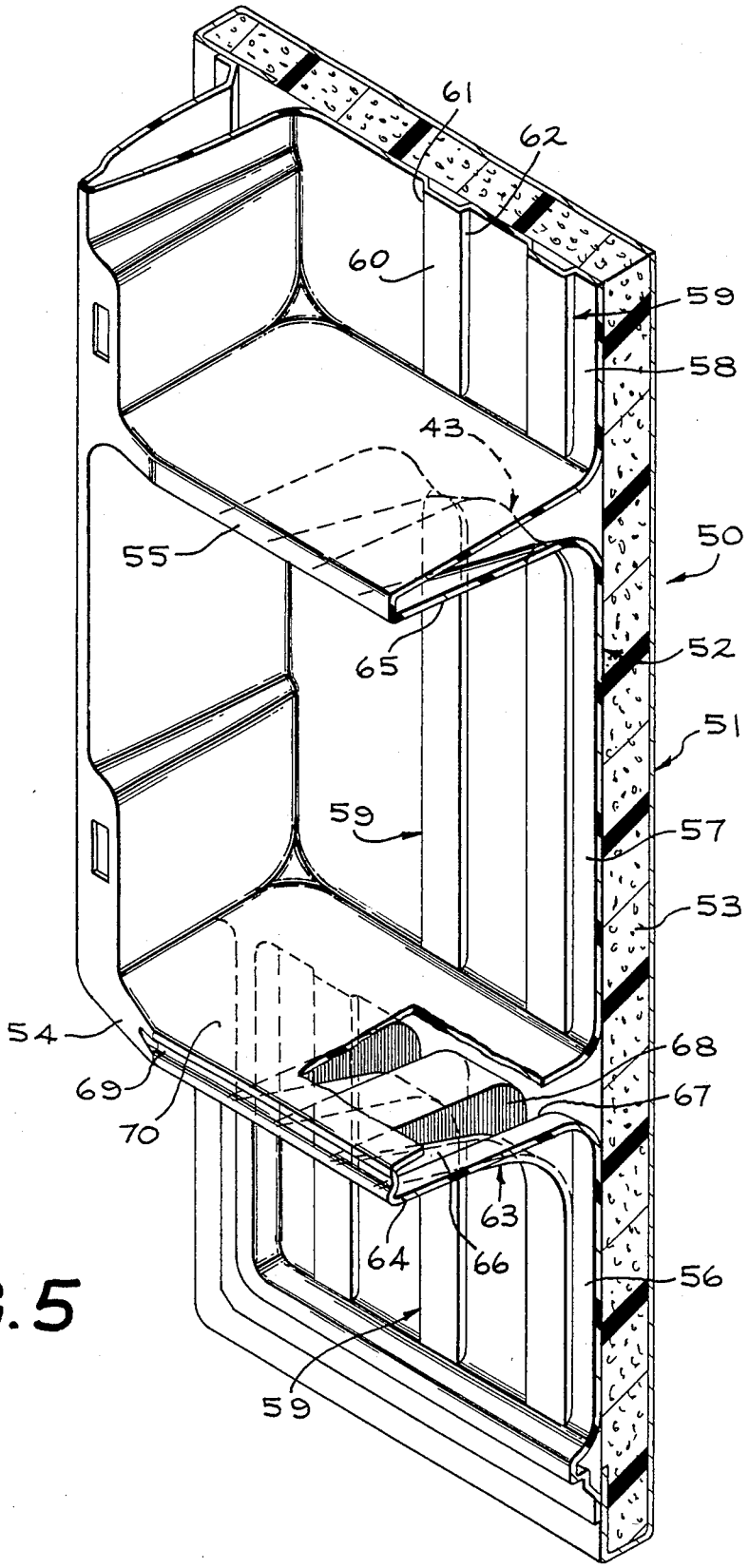
FIG. 5 is an enlarged fragmentary isometric view, partly in section, of a door having U-shaped stringers in its inner panel, its bottom shelf having U-shaped gussets and a shadow line, and its other shelves having V-shaped gussets.

Referring to FIG. 5, there is shown a lower door 50 for use with the refrigerator cabinet 10 (see FIG. 1) instead of the lower door 12. The lower door 50 (see FIG. 5) includes a metallic outer panel 51 and a plastic inner panel 52 joined in the same manner as the outer panel 17 (see FIG. 2) and the inner panel 18. An insulating foam 53 (see FIG. 5) is disposed between the outer panel 51 and the inner panel 52 of the lower door 50.

The inner panel 52 has a bottom shelf 54 with a plurality of additional substantially horizontal shelves (one shown at 55) thereabove. The bottom shelf 54 is spaced substantially from the bottom of the door 50.

The inner panel 52 has each of its substantially vertical surfaces 56, 57, and 58 formed with identical integral stringers 59. Each of the integral stringers 59 has a substantially U-shaped configuration having a base 60 and a pair of legs 61 and 62 extending at an angle greater than 90° from the base 60. The moment of inertia of each of the U-shaped integral stringers 59 is increased with an increase in the thickness of the base 60 (This is an increase in the thickness of the inner panel 52.), an increase in the distance between the inner surfaces of the legs 61 and 62 of the U-shaped stringer 59, or an increase in the length of each of the legs 61 and 62 of the U-shaped integral stringer 59.

Figure 10:
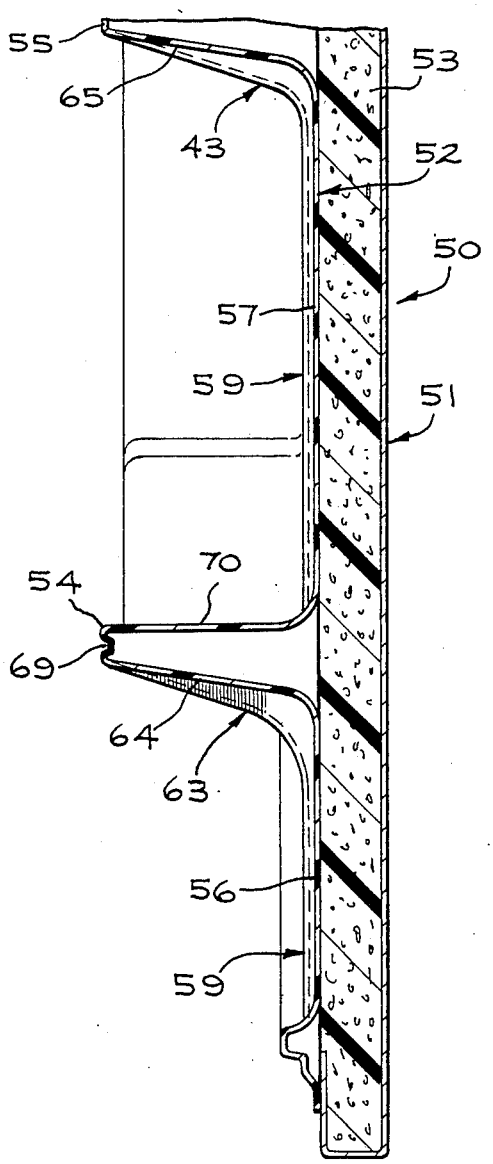
FIG. 10 is an enlarged fragmentary longitudinal sectional view of a portion of the door of FIG. 5 and showing the blending of a U-shaped integral stringer with a U-shaped gusset on a bottom surface of the lower shelf and the blending of the U-shaped stringer with a V-shaped gusset on the bottom surface of an intermediate shelf.

As shown in FIGS. 5 and 10, the integral stringers 59 blend into U-shaped gussets or trusses 63 in a lower surface 64 of the bottom shelf 54 having substantially the same U-shape as the integral stringers 59 and into the V-shaped gussets or trusses 43 in a lower surface 65 of the shelf 55 and a lower surface of each of the other shelves integral with the inner panel 52. As shown in FIG. 5, each of the gussets 63 has a base 66 of the same length between its legs 67 and 68 as the base 60 of the integral stringer 59, but the legs 67 and 68 are of varying length.

The bottom shelf 54 also has a shadow line 69, which is a groove, formed in its portion joining the bottom surface 64 and its upper surface 70. This enhances the moment of inertia while providing an aesthetic appearance.

The integral stringers 59 extend for approximately 90 to 95 per cent of the surfaces 57 and 58 of the inner panel 52 and for the entire width of the surface 56 of the inner panel 52. The integral stringers 59 can extend for the entire width of the surface 56 because there is no large ball radius beneath the lower surface 64 of the bottom shelf 54.

There is no decorative stringer in the surfaces 57 and 58 of the inner panel 52 although there could be if desired. Such decorative stringers would be of the same shape as the integral stringers 59.

Figure 7:
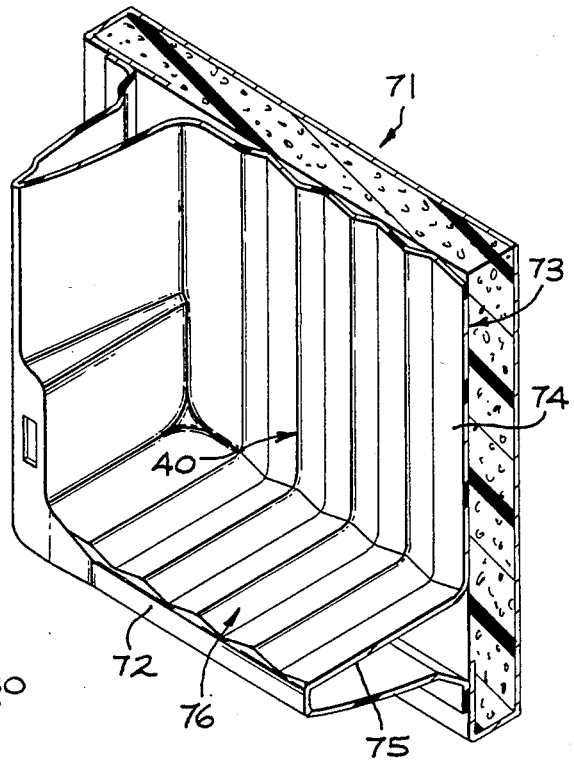
FIG. 7 is an enlarged fragmentary isometric view, partly in section, showing the lowermost portion of a door having its inner panel formed with V-shaped stringers and its lower shelf having V-shaped gussets on its upper surface.

Referring to FIG. 7, there is shown a portion of a lower door 71 for use with the refrigerator cabinet 10 (see FIG. 1) instead of the lower door 12. The lower door 71 (see FIG. 7) has a bottom shelf 72 formed integral with its inner panel 73. The inner panel 73 has its substantially vertical surface 74 extending upwardly from an upper surface 75 of the bottom shelf 71 to another shelf (not shown).

The surface 74 is formed with the integral stringers 40 of the same V-shaped configuration as shown in FIG. 3 for the lower door 12. However, there is no decorative stringer as the decorative stringer 49, for example, at each end of the integral stringers 40 in FIG. 7 although there could be if desired.

Each of the integral stringers 40 of the V-shaped configuration blends into a gusset or truss 76 of the same V-shape in the upper surface 75 of the bottom shelf 72. Thus, the gussets or trusses 76 provide rigidity to the bottom shelf 71. There is sufficient support surface on the gussets or trusses 76 for containers to be placed thereon without significant tilting.

Figure 8:
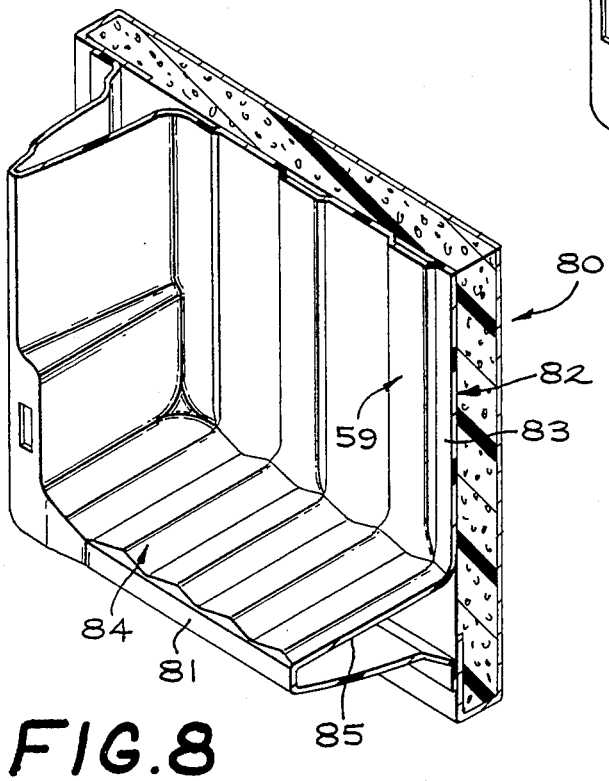
FIG. 8 is an enlarged fragmentary isometric view, partly in section, showing the lowermost portion of a door having its inner panel formed with U-shaped stringers with its lower shelf having V-shaped gussets on its upper surface.

Referring to FIG. 8, there is shown a lower door 80 for use with the refrigerator cabinet 10 (see FIG. 1) instead of the lower door 12. The lower door 80 (see FIG. 8) has its bottom shelf 81 formed integral with its inner panel 82 and other substantially horizontal shelves thereabove formed integral with the inner panel 82. The inner panel 82 has its substantially vertical surface 83 and its other similar substantially vertical surfaces formed with the integral stringers 59 of U-shaped configuration as in FIG. 5. There is no decorative stringer at each end of the integral stringers 59, which extend for approximately 90 to 95 per cent of the width of the surface 83, although there could be if desired. Such decorative stringers would be of the same shape as the integral stringers 59.

The bottom shelf 81 (see FIG. 8) has gussets or trusses 84 in its upper surface 85 formed of the V-shaped configuration in the same manner as the gussets or trusses 76 (see FIG. 7) of the lower door 71. Thus, the door 80 (see FIG. 8) has the integral stringers 59 of a different configuration than the gussets or trusses 84. However, they blend together to provide the desired rigidity to the inner panel 82 and the bottom shelf 81. The other shelves of the inner panel 82 would have the gussets or trusses 84 of the same configuration as the bottom shelf 81.

Accordingly, the gussets or trusses may be formed at either an upper or lower surface or both surfaces of a shelf of the inner panel of a refrigerator door for strengthening the shelves so that they will not deflect as much for a specific thickness of the inner panel. Furthermore, integral stringers may be utilized between the shelves to provide the desired stiffness to the inner panel whereby it does not have to be as thick to support increased loads.

It should be understood that the upper door 11 (see FIG. 1) may be similarly formed as the lower door 12. The present invention also may be employed with a refrigerator having a single door.

While the present invention has been shown and described for a refrigerator, it should be understood that any other appliance having a door with shelves on which containers or the like are to be supported may be so formed. Thus, the present invention may be used with any appliance door requiring stiffness and support of shelves integrally formed with the inner panel of the appliance door.

While the present invention has shown the integral stringers being formed of either a V-shape, which is an open triangle, or a U-shape, it should be understood that any other shape may be employed that will produce an aesthetic appearance in the inner panel in which it is formed while still obtaining the optimum moment of inertia to obtain a desired stiffness with an aesthetic appearance. Furthermore, while the integral stringers 59 (see FIG. 5) may be utilized with the V-shaped gussets or trusses 43 or 84 (see FIG. 8) or with the U-shaped gussets or trusses 63 (see FIG. 5), the V-shaped integral stringers 40 (see FIG. 4) can be employed only with the V-shaped gussets or trusses 43.

An advantage of this invention is that a substantial reduction in the amount of material required for an inner panel of an appliance door to support a specific load is obtained so as to substantially decrease the cost of the material. Another advantage of this invention is that an inner panel of an appliance door is stiffened without adding any material. A further advantage of this invention is that stress is diffused throughout the entire area of an inner panel of an appliance door rather than at limited local areas. Still another advantage of this invention is that the aesthetic appearance of an inner panel of an appliance door is maintained while increasing its stiffness.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. An appliance door including:
an outer panel;
an inner panel connected to said outer panel;
and said inner panel including:
a plurality of substantially horizontal shelves having an upper surface and a lower surface spaced from each other;
a substantially vertical surface extending between at least each two adjacent of said shelves;
a plurality of integral stringers of the same configuration adjacent each other and extending between at least two adjacent of said shelves in said substantially vertical surface extending therebetween;
and gusset means extending from one end of each of said integral stringers, said gusset means being in one of said upper and lower surfaces of at least one of said two adjacent shelves to add rigidity to said one shelf, each of said gusset means having the same configuration.

2. The door according to claim 1 in which each of said gusset means is in said upper surface of said shelf.

3. The door according to claim 2 in which each of said gusset means is the same configuration as each of said integral stringers.

4. The door according to claim 3 in which each of said integral stringers has a substantially V-shaped configuration.

5. The door according to claim 3 in which each of said integral stringers has a substantially U-shaped configuration.

6. The door according to claim 2 in which each of said integral stringers has a substantially U-shaped configuration and each of said gusset means has a substantially V-shaped configuration.

7. The door according to claim 1 in which each of said gusset means is in said lower surface of said shelf.

8. The door according to claim 7 in which each of said gusset means is the same configuration as each of said integral stringers.

9. The door according to claim 8 in which each of said integral stringers has a substantially V-shaped configuration.

10. The door according to claim 8 in which each of said integral stringers has a substantially U-shaped configuration.

11. The door according to claim 7 in which each of said integral stringers has a substantially U-shaped configuration and each of said gusset means has a substantially V-shaped configuration.

12. The door according to claim 1 in which each of said gusset means is the same configuration as each of said integral stringers.

13. The door according to claim 12 in which each of said integral stringers has a substantially V-shaped configuration.

14. The door according to claim 12 in which each of said integral stringers has a substantially U-shaped configuration.

15. The door according to claim 1 in which each of said integral stringers has a substantially U-shaped configuration and each of said gusset means has a substantially V-shaped configuration.

16. A method of forming an inner panel of an appliance door including:
forming a plurality of substantially horizontal shelves integral with the inner panel;
forming a plurality of integral stringers of the same configuration adjacent each other in a surface of the inner panel extending between at least two adjacent of the shelves for substantially the entire width of the shelves to increase the stiffness of the surface of the inner panel;
and forming gusset means of the same configuration in one of the upper and lower surfaces of at least one of the two adjacent shelves with each of the gusset means extending from one end of each of the integral stringers to add rigidity to the shelf having the gusset means.

17. The method according to claim 16 including forming the integral stringers and the gusset means of the same configuration.

18. The method according to claim 17 including forming each of the integral stringers and the gusset means in a substantially V-shaped configuration.

19. The method according to claim 17 including forming each of the integral stringers and the gusset means in a substantially U-shaped configuration.

20. The method according to claim 16 including:
forming each of the integral stringers in a substantially U-shaped configuration;
and forming each of the gusset means in a substantially V-shaped configuration.

* * * * *